US006595396B2

(12) United States Patent
Cummings et al.

(10) Patent No.: US 6,595,396 B2
(45) Date of Patent: Jul. 22, 2003

(54) APPARATUS FOR CARRYING AN INFANT

(76) Inventors: Quinn L. Cummings, 3870 Glenfeliz Blvd., Los Angeles, CA (US) 90039; Amy M. Turner, 9892 Beverly Grove Dr., Beverly Hills, CA (US) 90210

( * ) Notice: Subject to any disclaimer, the term of this patent is extended or adjusted under 35 U.S.C. 154(b) by 0 days.

(21) Appl. No.: 09/865,817

(22) Filed: May 25, 2001

(65) Prior Publication Data

US 2002/0185505 A1 Dec. 12, 2002

(51) Int. Cl.[7] ..... A45F 3/02

(52) U.S. Cl. ..... 224/158; 224/159; 224/160

(58) Field of Search ..... 224/158–160; 119/497

(56) References Cited

U.S. PATENT DOCUMENTS

| | | | | |
|---|---|---|---|---|
| 39,766 | A | | 9/1863 | Wheeler |
| 278,437 | A | | 5/1883 | Lancaster |
| 484,065 | A | | 10/1892 | Taylor |
| 522,108 | A | | 6/1894 | Kehlenbeck |
| 781,033 | A | | 1/1905 | Sutter |
| 1,039,009 | A | | 9/1912 | Averill |
| 1,162,662 | A | | 11/1915 | Sprong |
| 1,196,003 | A | | 8/1916 | Lippincott |
| 1,273,201 | A | | 7/1918 | Teuber |
| 2,409,331 | A | | 10/1946 | Wood |
| 2,411,721 | A | | 11/1946 | Hancock et al. |
| 2,468,588 | A | | 4/1949 | Clemens |
| 2,535,683 | A | | 12/1950 | Kimball |
| 2,689,672 | A | | 9/1954 | Thompson |
| 2,690,864 | A | | 10/1954 | Dautermann et al. |
| 3,197,100 | A | | 7/1965 | Thompson |
| 3,331,540 | A | | 7/1967 | Higuchi |
| 3,587,952 | A | | 6/1971 | Higuchi |
| 3,841,543 | A | | 10/1974 | Bolton |
| 4,149,687 | A | | 4/1979 | Nunemacher |
| 4,166,558 | A | | 9/1979 | Schroeder |
| 4,428,514 | A | | 1/1984 | Elf |
| 4,434,920 | A | * | 3/1984 | Moore ..... 224/160 |
| 4,436,233 | A | | 3/1984 | Hill et al. |
| 4,487,346 | A | | 12/1984 | Fischer, Jr. |
| 4,492,326 | A | | 1/1985 | Storm |
| 4,544,088 | A | | 10/1985 | Reding |
| 4,579,264 | A | | 4/1986 | Napolitano |
| 4,724,987 | A | | 2/1988 | Maheu |
| 4,750,653 | A | | 6/1988 | Prunty |
| 4,757,925 | A | | 7/1988 | Knittel |
| 4,815,639 | A | | 3/1989 | Lehman |
| D306,655 | S | | 3/1990 | Schlegel Liebert |
| 4,986,458 | A | * | 1/1991 | Linday ..... 224/160 |
| 5,011,057 | A | | 4/1991 | Perruzza et al. |
| 5,071,047 | A | | 12/1991 | Cordisco |
| D332,865 | S | * | 2/1993 | Wilmink ..... D3/31 |
| 5,205,450 | A | | 4/1993 | Derosier |
| 5,441,186 | A | | 8/1995 | Halligan |
| 5,490,620 | A | | 2/1996 | Bergqvist |
| 5,492,256 | A | | 2/1996 | Ive |
| 5,573,156 | A | | 11/1996 | McConnell |
| 5,632,425 | A | | 5/1997 | Hull |

(List continued on next page.)

*Primary Examiner*—Stephen K. Cronin
*Assistant Examiner*—Maerena W. Brevard
(74) *Attorney, Agent, or Firm*—Blakely, Sokoloff, Taylor & Zafman LLP

(57) ABSTRACT

A child or pet carrier characterized by an over-the-shoulder sling of sufficient width and strength to support the weight of an infant, young child, or small pet which connects to an increased width of fabric or joined panels of fabric designed and constructed to form a holding portion that allows the child to rest in a sitting or reclined posture when held against the side, hip, or torso area of a carrying adult and that is further enhanced by an integrated drawstring, adjustable strap, or rubberized compression cord that runs along one transverse side of the holding portion that can be adjusted in such a manner as to create a more stable back and/or side support for the child or pet held therein.

13 Claims, 3 Drawing Sheets

U.S. PATENT DOCUMENTS 5,673,828 A 10/1997 Raedel et al.
5,732,861 A 3/1998 Jakobson
5,772,088 A 6/1998 Nelson
5,857,598 A 1/1999 Dunne
D407,213 S * 3/1999 McConnell ..... D3/213
5,950,887 A 9/1999 Powell
6,045,018 A 4/2000 Onishi
6,098,856 A 8/2000 Reilly
6,112,960 A 9/2000 Seering et al.
6,182,873 B1 * 2/2001 Christopher et al. ..... 224/159
6,186,381 B1 2/2001 Kernkamp

* cited by examiner

APPARATUS FOR CARRYING AN INFANT

FIELD OF THE INVENTION

This invention relates generally to devices for carrying items, and more particularly to devices for carrying children or small pets.

BACKGROUND

The use of a shoulder sling to carry a child dates back to prehistoric times. The simple task of toting a baby securely requires little more than a basic loop of fabric—technique used by caregivers in virtually every culture at some point in its history. Improvements to the basic sling have included adding a solid shelf support for the hip (U.S. Pat. No. 781,033); making the length-adjustment buckle more secure (U.S. Pat. No. 5,857,598); adding adjustable bumpers (U.S. Pat. No. 5,950,887); refining the pouch (U.S. Pat. No. 4,757,925); incorporating pillows and cushions (U.S. Pat. No. 6,112,960); designing the sling to accept a car seat (U.S. Pat. No. 5,573,156); incorporating the sling with a stabilizing hip belt (U.S. Pat. Nos. 4,544,088; 4,724,987; and 4,436,233); and numerous other refinements.

Child carrying devices fall into three basic categories: simple slings, two-shoulder carriers, and hip carriers. These categories can be further broken into combinations and subsets such as inward-facing versus outward-facing, front-pack versus back-pack, prone versus seated, leg separation, lap and shoulder restraints, and other defining embodiments, each of which is well represented in the art. The claimed invention derives from the simple sling configuration.

The basic, over-the-shoulder sling is recommended by various pediatric books and publications (Sears, Ch. 14, Parenting Magazine, April, 2001, pp. 153–159). A significant advantage to the basic sling is that the child has numerous options as to seating and/or lying position depending on the configuration of the sling on the parent's shoulder and the child's position within it. However, in order to safely accommodate numerous permutations of child size and carrying position, these hammock-like slings must incorporate a considerable area of fabric, which by careful alignment of the folds, seams, and integrated bumpers, can be adjusted to accommodate the child in various seating and lying positions. Although simple in design, these slings tend to be quite bulky and cumbersome to wear.

This bulkiness is problematic for several reasons. It renders the sling heavy and difficult to pack and/or store. It requires more material to manufacture. It tends to add visual "weight" to the wearer. This visual weight is particularly undesirable in that women, especially women who have recently given birth, are particularly sensitive about any clothing or accessory that might make them appear heavier than they are.

The most basic support elements of a sling are a shoulder strap and a side/back rest. There are several examples of devices which focus on these basic elements (U.S. Pat. Nos. 522,018 and 2,468,588), but they all tend to forfeit safety and comfort to achieve simplicity. For instance, the "boson's chair" approach, a semi-rigid seat, tends to lack flexibility and comfort (U.S. Pat. No. 2,690,864).

Other sling variations incorporate a drawstring to configure the protective bumpers or edge gunwales of hammock-like devices (U.S. Pat. Nos. 5,950,887 and D332,865).

DESCRIPTION OF THE DRAWINGS

Various embodiments are illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

DETAILED DESCRIPTION

Various embodiments disclosed herein overcome the problems in the existing art described above by providing a sling with a stabilizing cord configured to increase the security and flexibility of the sling. In the following description, for the purposes of explanation, numerous specific details are set forth in order to provide a thorough understanding of the various embodiments. It will be apparent, however, to one skilled in the art that the embodiments may be practiced without some of these specific details. The following description and the accompanying drawings provide examples for the purposes of illustration. However, these examples should not be construed in a limiting sense as they are merely intended to provide exemplary embodiments rather than to provide an exhaustive list of all possible implementations.

Figure 1:
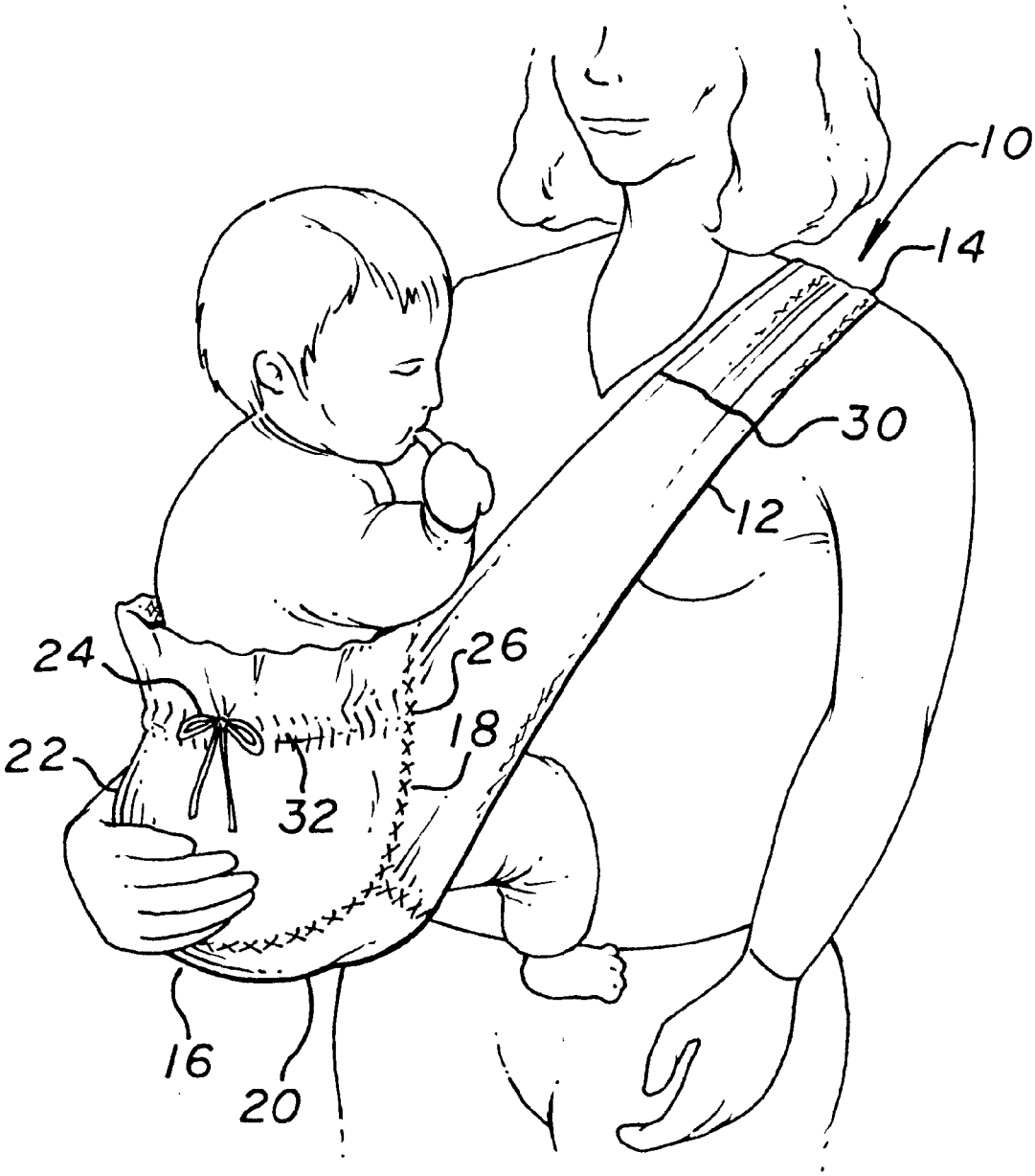
FIG. 1 is an environmental, perspective view of an embodiment in use with the stabilizing cord and its adjustment knot extending through a single aperture.

FIG. 1 is an environmental, front perspective view of an embodiment of the device in use. A sling 10 is shown which has a shoulder strap portion comprised of a front shoulder strap 12 and a rear shoulder strap 14. Although the embodiment shown has a two-piece shoulder strap portion, it is contemplated to have either the shoulder strap portion or the entire device comprised of one piece of fabric. Continuing on, the front shoulder strap 12 and the rear shoulder strap 14 can be made of fabric or any material suitable for use as a sling for carrying a child. The embodiment shown also has a holding portion 16 fabricated from panels of fabric sewn together using stitching 18 of sufficient strength to hold a child or small pet weighing from approximately seven to over thirty pounds while still allowing the child to shift sitting positions while in the device. The holding portion 16 includes a bottom portion 20 proximal to the user's body and a side portion 22 distal to the user's body, the side portion 22 being positioned higher than the bottom portion 20.

A stabilizing cord 24 is located across the transverse area of the side portion 22. In an embodiment, the stabilizing cord 24 is adjustable to provide additional support and comfort for the child or small pet being held. The stabilizing cord 24 is anchored to both the front shoulder strap 12 (shown at location 26) and the rear shoulder strap 14 (shown at location 28 in FIG. 2) in such a manner as to provide maximum comfort and support. It is worth noting that the stabilizing cord 24 can be made of rope, elastic material, rubberized compression cord, nylon webbing, ribbon, or the like. As such, the stabilizing cord provides the device a wide range of secure seating and holding configurations while adding very little bulk or material weight. Also, the entire device can be folded or stuffed into a relatively small container.

The tension of the stabilizing cord 24 can be readily adjusted to suit the needs of the user based on the child's size and the position in which the user desires to hold the child (e.g. sitting upright, prone, reclining, etc.). Notably, the adjustments may be readily accomplished while the device is in use without removing the child. In an embodiment, the tension may be adjusted and secured by any suitable means. For example, the means for adjusting the stabilizing cord can include a knot in the stabilizing cord 24, a buckle, a clamp, a cord lock, or the like. As such, the user may adjust the tension of the stabilizing cord either before putting on the device or while wearing the device with the child or small pet in the device. Thus, the stabilizing cord adds great flexibility to the ease and manner of use.

In various embodiments, the stabilizing cord 24 is maintained in position by a guide channel 32 defined by the holding portion 16 and/or loops disposed on the holding portion 16. For example, FIG. 1 shows a guide channel 32 defined by the holding portion 16 in which the stabilizing cord 24 is disposed. Note that the guide channel 32 is distal to the user's body in this embodiment.

One advantage of locating the stabilizing cord symmetrically across the back of the holding portion with the stabilizing cord anchored to both front and back shoulder straps 12 and 14 is that the tension on the stabilizing cord can be varied in either direction. This allows the child to sit securely against the hip, belly or torso of a carrying adult in either a right-handed or left-handed configuration.

Also in an embodiment, a further adjustment can be made to raise or lower the child in the device by means for adjusting the shoulder strap portion in order to raise or lower the holding portion 16. For instance, the means for adjusting the shoulder strap portion can include a knot, a buckle, a clasp, a clip, a cinch, a hook-and-loop fastener, a hook-and-eye fastener, or the like. Furthermore, the means for adjusting can be disposed on an inner side of the shoulder strap portion or hidden in another suitable manner. For example, FIG. 1 includes a concealed buckle 30 to adjust the shoulder strap portion. In the hidden buckle embodiment, the length of strap shortened by the buckle may also serve as a pad to cushion the contact point between the buckle and a user's shoulder. Similar to the stabilizing cord adjustment means, the means for adjusting the shoulder strap may also be adjusted either before putting on the device or while wearing the device, which adds greater flexibility to the manner of using the device.

Figure 2:
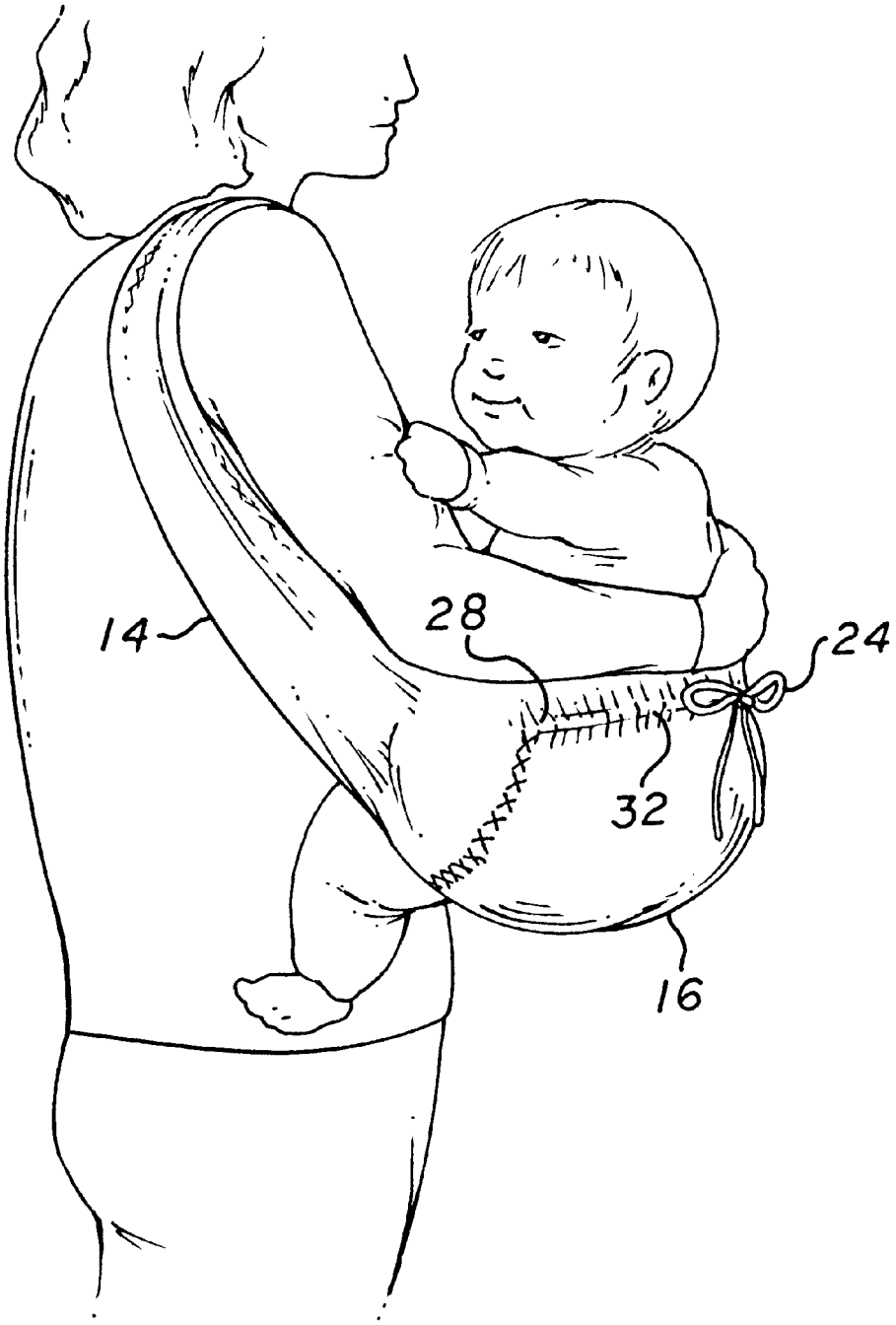
FIG. 2 is an environmental view of the same embodiment as seen from the side-rear of the user.

FIG. 2 is an environmental view of the device of FIG. 1 as seen from the side-rear of the user. The relationship between the rear shoulder strap 14 and the holding portion 16 is evident as well as the continuation of the stabilizing cord 24 in the guide channel 32. This perspective also further demonstrates how the child can be held securely and close yet with a fuller range of motion than afforded by use of a more bulky sling.

Figure 3:
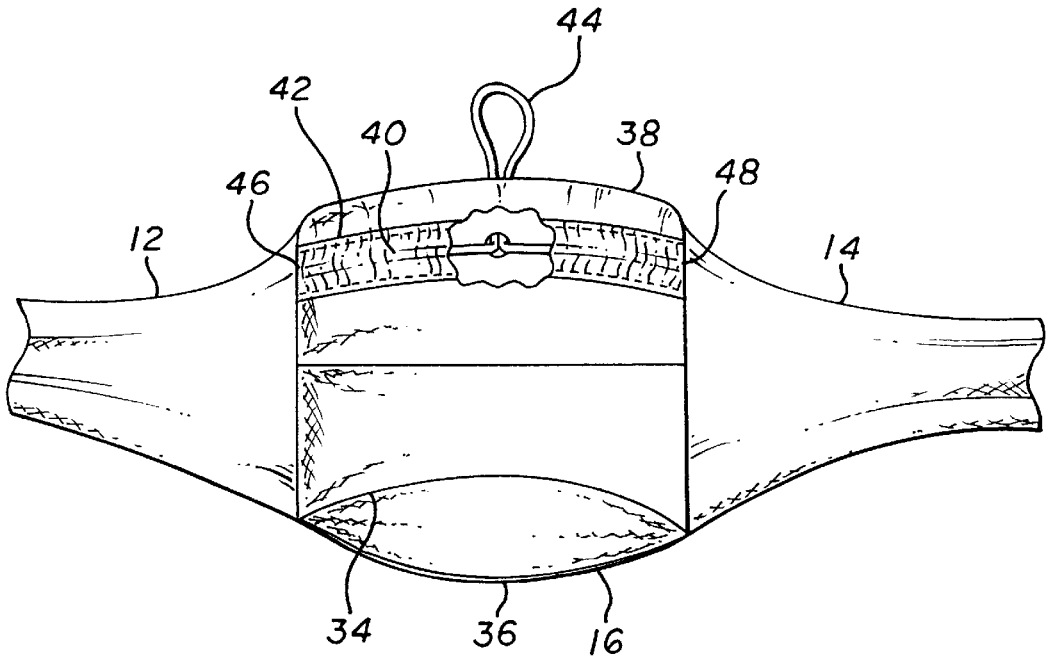
FIG. 3, is a view of the inside of an embodiment of the sling with a cutaway portion showing the aperture through which the stabilizing cord extends for adjustment.

FIG. 3 is a view of the inside of an embodiment which has the front shoulder strap 12 and the rear shoulder strap 14 laid open. The holding portion 16 of this embodiment consists of a seat panel 34, a leg support panel 36, and a backrest panel 38. The backrest panel 38 also contains an additional band of material 40 that defines the guide channel 42 through which the stabilizing cord 44 is threaded. Each end of the stabilizing cord 44 is permanently anchored to the backrest panel 38. For instance, a first end is anchored near the seam 46 with the front shoulder strap 12, and the second end is anchored near the seam 48 with the rear shoulder strap 14. Although the embodiment shown describes the stabilizing cord anchored to the backrest panel, it is contemplated to have the stabilizing cord anchored to either the backrest panel or the shoulder straps.

With both ends anchored, a bight (e.g. loop or bend) of the stabilizing cord 44 can extend through an aperture (shown in the cutaway portion of FIG. 3) to the outside of the backrest panel 38 for adjustment. In addition, a grommet may be disposed within the aperture to strengthen the aperture. In various embodiments, the inside of the device will be lined for added comfort, but such a lining is not essential.

Figure 4:
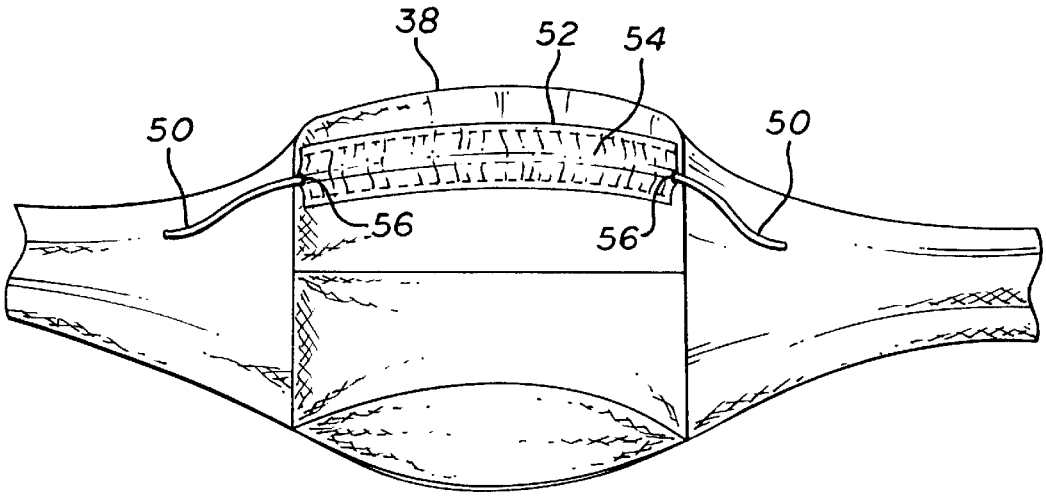
FIG. 4, is a view of the outside of another embodiment with a center-anchored stabilizing cord and apertures located on the transverse extremes of the backrest panel.

FIG. 4 shows the outside of an alternative configuration in which an intermediate portion of the stabilizing cord 50 is anchored to a central region 52 of the backrest panel 38 and disposed in guide channel 54. As such, the two ends of the stabilizing cord 50 can extend out through two apertures 56 located on the transverse extremes of the backrest panel 38 where each end can be individually adjusted and secured in place by any of the adjustment means described above. In another embodiment, the stabilizing cord 50 can be comprised of two cords, each having a first and second end, with the first end of each cord anchored to the central region 52 of the backrest panel 38. Thus, the second end of each cord can extend through an aperture 56 for adjustment.

Alternatively, stabilizing cord 50 could be comprised of two separate cords each having a first and a second end, with the first end of each cord anchored to the shoulder strap portion and the second end of each cord free to extend through an aperture located in an intermediate section of the holding portion for adjustment. While these are more complex arrangements to manufacture, they do allow for a more precise adjustment with respect to front- or rear-facing alignment and, thus, might prove more suitable embodiments for certain caregivers' needs.

It is to be understood that even though numerous characteristics and advantages of various embodiments have been set forth in the foregoing description, together with details of the structure and function of the various embodiments, this disclosure is illustrative only. Changes may be made in detail, especially matters of structure and management of parts, without departing from the scope of the various embodiments as expressed by the broad general meaning of the terms of the appended claims.

We claim:

1. A device for carrying items comprising:

a shoulder strap portion having at least one panel of fabric to be disposed about and supported by a shoulder of a user;

a holding portion coupled to the shoulder strap portion, such that the shoulder strap portion is capable of independently supporting the weight of the holding portion with at least one item disposed therein, the holding portion having at least one panel of fabric to form a holding area suitable for holding items approximately the size of a child or a small pet; and a stabilizing cord to be anchored to the shoulder strap portion and to be guided by a loop disposed on the holding portion, the stabilizing cord being adjustable to provide additional support for the item to be held.

2. The device of claim 1, wherein the shoulder strap portion comprises a first panel of fabric and a second panel of fabric sewn together.

3. The device of claim 1, further comprising:

means for adjusting the stabilizing cord, wherein the stabilizing cord is adjustable by varying the tension on at least a portion of the stabilizing cord.

4. The device of claim 1, further comprising:

means for adjusting the shoulder strap portion on the shoulder of the user in order to raise or lower the holding portion.

5. The device of claim 4, wherein the means for adjusting includes at least one of a knot, a buckle, a clasp, a clip, a cinch, a hook-and-loop fastener, and a hook-and-eye fastener.

6. The device of claim 4, wherein the means for adjusting is disposed on an inner side of the shoulder strap portion.

7. The device of claim 1, wherein the fabric panels are configured to form a bottom portion proximal to a body of the user and a side portion distal to the body of the user, the side portion being higher than the bottom portion.

8. The device of claim 1, wherein the stabilizing cord comprises at least one of rope, an elastic material, rubberized compression cord, nylon webbing, and ribbon.

9. A device for carrying a child comprising:

a shoulder strap portion having at least one panel of fabric to be disposed about and supported by a shoulder of a user and means for adjusting the shoulder strap portion on the shoulder of the user;

a holding portion coupled to the shoulder strap portion, such that the shoulder strap portion is capable of independently supporting the weight of the holding portion with at least one item disposed therein, the holding portion having at least one panel of fabric to form a holding area suitable for holding the child; and a stabilizing cord, a portion of which is to be anchored to one of the shoulder strap portion and the holding portion and to be guided by a loop disposed on the holding portion, the stabilizing cord being adjustable to provide additional support for the child being held.

10. The device of claim 9, further comprising:

means for adjusting the stabilizing cord, wherein the stabilizing cord is adjustable by varying the tension on at least a portion of the stabilizing cord.

11. A device for carrying a child comprising:

a shoulder strap portion having at least one panel of fabric to be disposed about and supported by a shoulder of a user and means for adjusting the shoulder strap portion on the shoulder of the user;

a holding portion coupled to the shoulder strap portion, such that the shoulder strap portion is capable of independently supporting the weight of the holding portion with at least one item disposed therein, the holding portion having at least one panel of fabric to form a holding area suitable for holding the child; and a stabilizing cord comprising two separate cords each having a first end and a second end, the first end of each cord anchored to the shoulder strap portion, and wherein the holding portion defines a guide channel for the stabilizing cord distal to a body of a user, and wherein the holding portion further defines an aperture through which the second end of each cord which is not anchored to the shoulder strap portion can extend to be adjusted by the user based on the size of the child and the position in which the user desires to hold the child.

12. The device of claim 11, further comprising:

a grommet disposed within the aperture to strengthen the aperture.

13. A device for carrying a child comprising:

a shoulder strap portion having at least one panel of fabric to be disposed about and supported by a shoulder of a user and means for adjusting the shoulder strap portion on the shoulder of the user;

a holding portion coupled to the shoulder strap portion, such that the shoulder strap portion is capable of independently supporting the weight of the holding portion with at least one item disposed therein, the holding portion having at least one panel of fabric to form a holding area suitable for holding the child; and a stabilizing cord that has a first end, a second end, and an intermediate section, at least a portion of the intermediate section of the stabilizing cord anchored to the holding portion, the stabilizing cord being adjustable to provide additional support for the child being held.

* * * * *